United States Patent [19]

Stahlecker

[11] 4,038,812

[45] Aug. 2, 1977

[54] OPEN-END SPINNING MACHINE HAVING SPINNING UNITS WITH REMOVAL OPENING FOR IMPURITIES

[75] Inventor: Fritz Stahlecker, Bad Uberkingen, Germany

[73] Assignees: Fritz Stahlecker; Hans Stahlecker, both of Germany

[21] Appl. No.: 636,832

[22] Filed: Dec. 2, 1975

[30] Foreign Application Priority Data

Dec. 11, 1974 Germany ..... 2458538

[51] Int. Cl.[2] ..... D01H 11/00; D01H 1/12

[52] U.S. Cl. ..... 57/56; 57/58.95

[58] Field of Search ..... 57/34 R, 56, 58.89–58.95

[56] References Cited

U.S. PATENT DOCUMENTS

| | | | |
|---|---|---|---|
| 3,777,329 | 12/1973 | Lane | 57/58.89 X |
| 3,777,466 | 12/1973 | Kabele et al. | 57/58.89 |
| 3,884,027 | 5/1975 | Schumann et al. | 57/56 |
| 3,884,028 | 5/1975 | Stahlecker et al. | 57/56 |
| 3,892,063 | 7/1975 | Doudlebsky et al. | 57/56 |
| 3,911,660 | 10/1975 | Stalder | 57/58.89 |
| 3,924,397 | 12/1975 | Stahlecker et al. | 57/56 |

*Primary Examiner*—Donald Watkins
*Attorney, Agent, or Firm*—Craig & Antonelli

[57] ABSTRACT

In order to clean the fibrous material supplied to the spinning rotors of open-end spinning units, removal openings for impurities are arranged in the area of the opener roller. These removal openings lead to collection chambers for the impurities. In order to permit these impurities to be removed from these collection chambers without any additional constructional effort for transport means having to be provided for each spinning unit and without this removal being able to have an unfavorable effect on the spinning process, this removal of impurities is handled by a travelling maintenance unit which removes the impurities from the collection chambers of the individual spinning units from time to time.

27 Claims, 12 Drawing Figures

104
12
103
93
95
94
105
34
11
48
95
39
10
36
101
102
9
40
99
100
19
98
56
96
97
4
2

OPEN-END SPINNING MACHINE HAVING SPINNING UNITS WITH REMOVAL OPENING FOR IMPURITIES

The present invention relates to an open-end spinning machine having a plurality of spinning units arranged one next to the other, each of the spinning units having supply and opening means with a removal opening in the area of an opener roller.

It is known practice (German Published Patent Application No. 1,914,115) to provide an impurities removal opening with a removal edge, followed by a collection chamber, from which the removed impurities are sucked continuously and pneumatically, in the area beneath an opener roller. In this design, it is difficult to design the suction means in such a manner that the spinning process is not disturbed by the airstream being influenced in the area of the opener roller, as the airstream primarily provides transport of the fibres to a spinning rotor and thus directly influences the quality of the thread spun. It is therefore also known practice (German Published Patent Application No. 1,922,078) to provide a cover for the removal opening in this design and to suck out the impurities intermittently, which is only performed when the cover is closed. However this solution results in considerable engineering difficulties.

In order to avoid the aforementioned difficulties, it is also known practice (German Disclosed Patent Application No. 2,231,578) to have the collection chamber, located behind the removal opening, followed by mechanical conveying means, which prevent the spinning process from being affected by pneumatic fibre removal. This solution, which is highly advantageous in terms of spinning technology, requires somewhat greater constructional effort. Moreover, the mechanical conveying means must be cleaned from time to time, which requires the operating personnel to perform maintenance work.

It is an object of the present invention to design an open-end spinning machine in such a manner that the impurities are removed from the area of the spinning units without interruption of the spinning process and without the operating personnel having to perform any maintenance work.

According to the present invention, this object is solved in that a collection chamber for the impurities follows each of the removal openings, the collection chamber having a connection opening for exhausting means which are arranged on a maintenance unit travelling along the open-end spinning machine and which contain means for advancement to said connection openings.

As a result of this design, it is possible to clean the individual spinning units at useful intervals without noticeably disturbing the spinning process. Moreover, the fabricational effort for the individual spinning units is significantly lower, thereby making the spinning units less expensive.

In order to prevent, to a greater degree, the removal of the impurities from the collection chamber from disturbing the spinning process, it is possible to provide the maintenance unit with a screen which can be placed in the collection chamber between removal opening and connection opening for the exhausting means. This measure prevents the spinning process from being disturbed, even with a high suction. It is possible to provide this screen by means of a special air supply or a mechanical member.

In order to even further utilize the maintenance unit and, in particular, to also clean other areas which require cleaning after a certain period of operation, the maintenance unit is equipped with a plurality of pneumatic means associated to further connection openings in the spinning units. In this connection, it is advantageous for each spinning unit to be equipped with pneumatic lines running from those points to be cleaned in said spinning unit to connection openings, to which the pneumatic means of the maintenance unit can be attached. It is especially advantageous for the connection openings of a spinning unit to be arranged in one common connection plate, to which a counterplate of the maintenance unit can be attached, the counterplate being connected with pneumatic means of the maintenance unit by means of pneumatic lines. With this development, it is possible to design both the individual spinning units as well as the maintenance unit in a relatively simple manner as a plurality of positioning movements is not required.

In order to ensure that the airstreams produced for the cleaning operation are directed and controlled in such a manner that the airstreams usually present, especially in the area of the path of travel of the fibres, are not significantly influenced, so that the spinning process is also not negatively influenced, it is possible for the pneumatic lines of the maintenance unit to be connected to pneumatic supply means by means of valves which are controlled in accordance with a programme. For the same purpose, it is also possible to connect the pneumatic lines of the maintenance unit to joint pneumatic supply means and to equip the pneumatic lines with means for generating different airstreams.

The above discussed and other objects, features and advantages of the present invention will become more apparent from the following description thereof, when taken in connection with the accompanying drawings, in which FIG. 1 shows a vertical section through an open-end spinning machine having a maintenance unit intended for the removal of impurities from an impurities collection chamber;

Figure 1:
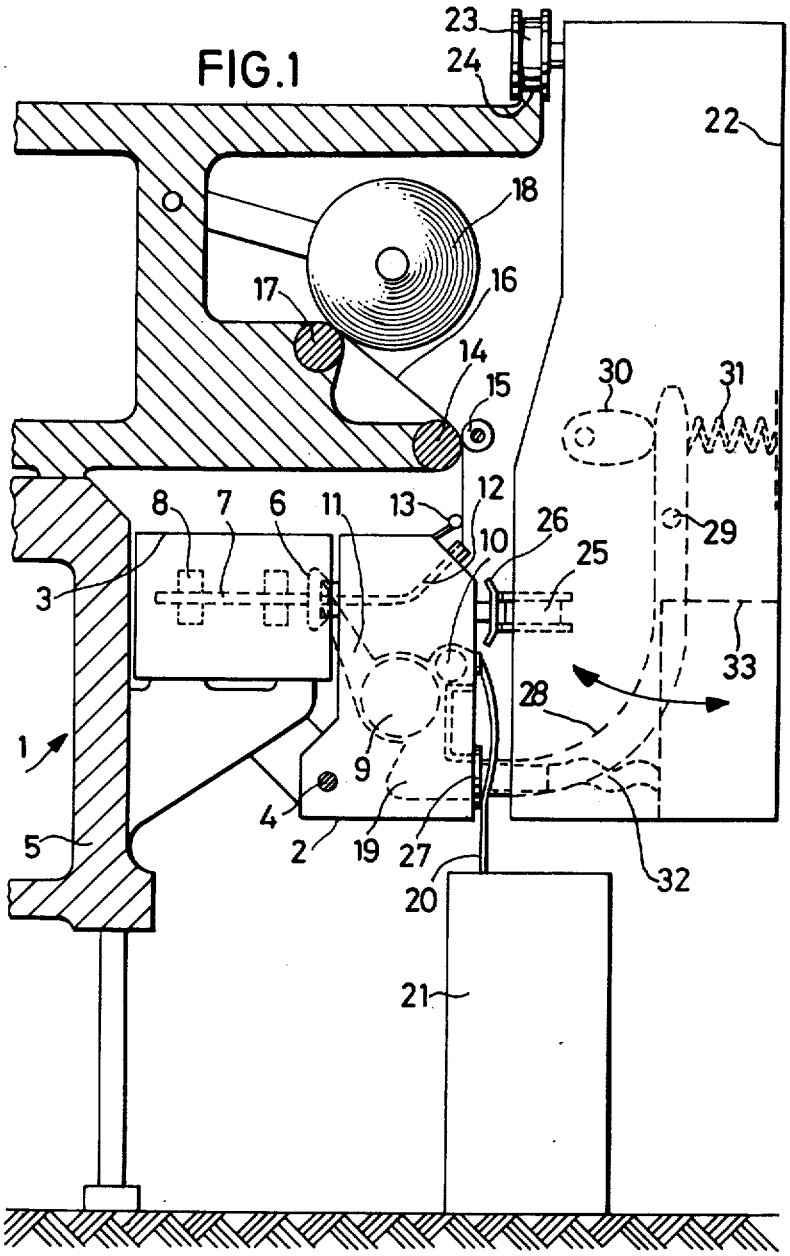

Referring now to the drawings, wherein like reference numerals designate like parts throughout the several views, the machine frame 5, shown in section in FIG. 1, supports a plurality of spinning units 1 of uniform design, arranged in a row one next to the other. These spinning units 1 contain supply and opening means in a housing 2 which can be pivoted about an axle 4; these supply and opening means open a sliver from a can 21 into individual fibres and supply them to a spinning rotor 6, from where they are then drawn off as a thread. The supply and opening means contain a supply roller 10 which operates with an undercasing in an unillustrated manner and, together with the undercasing, offers the sliver to an opener roller 9, running at a much higher speed. Opener roller 9 supplies the fibres to spinning rotor 6, which is located in a housing 3, via a fibre supply channel 11. The shaft of spinning rotor 6 is mounted in bearings 8 and driven in an unillustrated manner. Arranged coaxially to shaft 7 of spinning rotor 6 in housing 2 is a yarn removal channel 12, which is angled upwardly. Arranged at the mouth of yarn removal channel 12 is a thread stop-motion 13, through which the spun thread 16 is drawn off by a pair of rollers 14, 15, which advance the thread to a friction roller 17, which drives a winding bobbin 18.

While being opened by opener roller 9, sliver 20 is subjected to a cleaning process. A removal opening for impurities and a collection chamber 19 are arranged for this purpose in the area of the opener roller. The impurities must be removed from collection chamber 19; in known designs, this is accomplished by suction means arranged on the machine, or more particularly on the machine frame. However their attachment is complicated and results in difficulties if housing 2, as in the illustrated embodiment, contains the supply and opening means and can be swivelled away from housing 3 together with these members for opening the spinning unit. In order to clean collection chamber 19 in the illustrated embodiment, a maintenance unit 22, which travels along the open-end spinning machine and which is guided on a rail 24, arranged above the spinning unit, by means of wheels 23 and on a lower rail 26, which is preferably combined from individual members attached to housings 2, by wheels 24 is provided. At least one of wheels 23 has unillustrated drive means.

Travelling maintenance unit 22 contains suction means which are associated to a connection opening 27 in collection chamber 19, arranged on an end of housing 2. The suction means comprise a suction line 32 which can be pressed against connection opening 27 by means of a connection. Suction line 32 is pressed against connection opening 27 by means of a lever, which can be pivoted about an axle 29, whose swivel movement is performed by an eccentric 30 against the force of a compression spring 31. Suction line 32 is connected with an impurities chamber 33 of maintenance unit 22; impurities chamber 33, in turn, is also connected with suction means in an unillustrated manner. A vacuum pump, driven by an electric motor, can be employed for this purpose, for example.

It has been found that connection opening 27 need not necessarily be closed for normal spinning operations if it is arranged at a sufficient distance from the opener roller. It is also favourable if the connection opening is located in such a manner that the suction draft is not directed toward the opener roller, i.e. the connection opening should be arranged in a side wall of the connection chamber. The impurities collection chamber can be cleaned during normal spinning operations, without having to fear that the spinning process would be affected. Maintenance unit 22 travels along the spinning machine, emptying collection chambers 19 of the individual spinning units one after another or in a different, preselected sequence. In this embodiment, the individual spinning units can be fabricated very simply and economically, as they do not need to contain any additional means for drives, etc., even for removing the impurities contained in the fibrous material.

Figure 2:
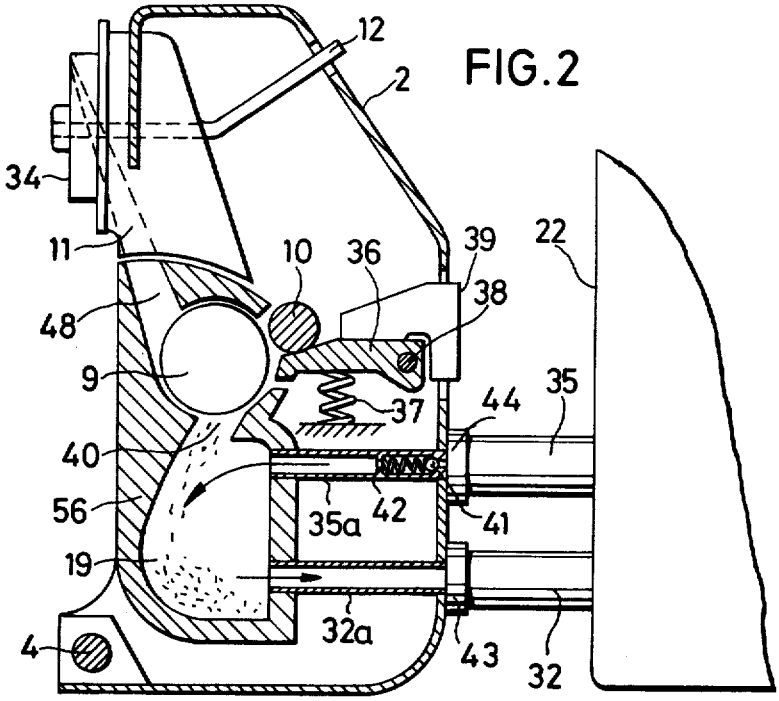
FIG. 2 shows a section through a detail of FIG. 1.

In the embodiment according to FIG. 2, housing 2, which can be pivoted about axle 4, is designed as a cover for stationary supply and opening means. An inlet hopper 39, the supply roller 10 with an undercasing lever which can be pivoted about an axle 38 against the force of a spring 37, as well as opener roller 9 are located in a stationary housing member 56, which has a removal opening 40 in the area of the periphery of opener roller 9, which leads to a connection chamber 19 for the impurities removed. Housing 2 is connected with an insert 34, which protrudes into the unillustrated spinning rotor. This insert 34 contains a portion of fibre supply channel 11, of which the initial section 48 is integrated into housing 56. Moreover, insert 34 also contains yarn removal channel 12.

Collection chamber 19 for the impurities has two connection openings **32*a* and 35*a*, which are formed by sections of pipe inserted into housing 56 and extending to the area of the wall of housing 2, which is designed as a cover and which has corresponding holes there so that the openings of the sections of pipe are open to the outside. The lower section of pipe serves as connection opening 32*a* for a suction line 32 of a maintenance unit 22, which can be designed in accordance with the embodiment shown in FIG. 1. Suction line 32 is positioned over the section of pipe serving as connection opening 32*a*, with an elastic mouth 43 of suction line 32 preventing the suction draft from escaping. Second connection opening 35*a* is attached in such a manner that it is located between removal opening 40 and connection opening 32*a*, through which the impurities are sucked out. Compressed air is supplied through upper connection opening 35*a*, for which purpose a compressed air line 35 of maintenance unit 22, having an elastic spacer 44 at its mouth, can be positioned over it. Compressed air is blown into collection chamber 19 by means of this compressed air line 35 while the impurities are being sucked out in order to equalize the pressure, at least in the area of the removal opening, so that the airstream in the area of the opener roller and section 48 of fibre supply channel 11 that follows is not influenced. The stream of compressed air blown in through this connection opening 35*a* provides screening against the penetration of infiltrated air. It is practical for the rear wall of the collection chamber, facing away from connection openings 32*a* and 35*a*, to be curved in such a manner as to direct the incoming stream of air downward toward the base of collection chamber 19, and thus in the area of connection opening 32*a*. Since connection opening 35*a* and the section of pipe serving as this connection opening are arranged relatively close to removal opening 40, in actual practice it is advantageous for a valve, comprising a ball 41 and a spring 42**, for example, which only opens at a preselected pressure, to be arranged there.

Figure 3:
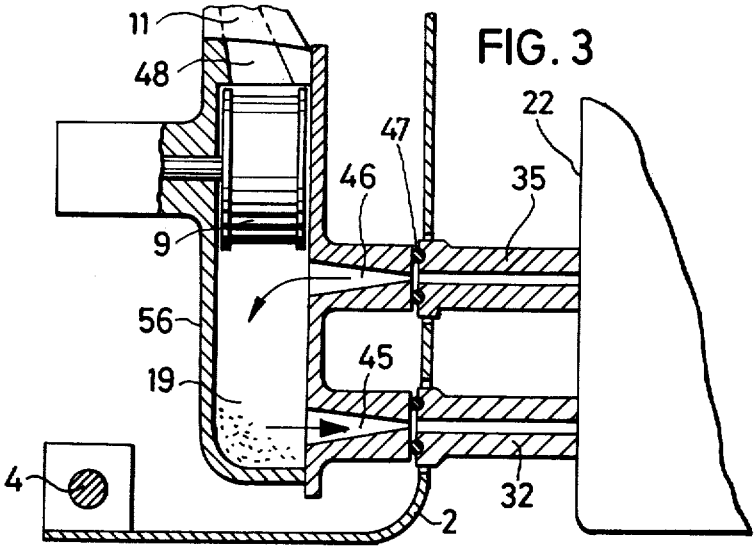
FIG. 3 shows a partial section, similar to FIG. 2, through a further embodiment.

In the embodiments according to FIGS. 1 and 2, the axes of opener roller 9 and supply roller 10 are located in planes which are perpendicular to the axis of spinning rotor 6 and, in the same manner as swivel axle 4, are arranged in the longitudinal direction of the machine. It is, of course, readily possible to also arrange the axes of the supply roller and the opener roller in planes which are parallel to the axis, and shaft 7, of spinning rotor 6. An embodiment of this type is shown in FIG. 3, which corresponds largely to the embodiment shown in FIG. 2 with respect to the remainder of its design. In the area of the base of collection chamber 19, located beneath opener roller 9 and an unillustrated removal opening, housing 56 has a connection opening 45, and a connection opening 46 located thereabove, each being designed as projections of two-section housing 56. Connection openings 45 and 46 are both set back somewhat relative to the outer wall of housing 2, which can be swivelled away, so that suction line 32 and compressed air line 35 have to penetrate the wall of housing 2 through corresponding holes. The mouths of suction line 32 and compressed air line 35 are surrounded by seals, which come into a contacting relationship with the faces of connection openings 45 and 46. Here, also, the removal opening and the area located thereabove are screened by the introduction of compressed air, permitting high suction drafts to be employed. Connection openings 45 and 46 are tapered toward the outside, so that no special sealing or closing means are required for normal spinning operations.

Figure 4:
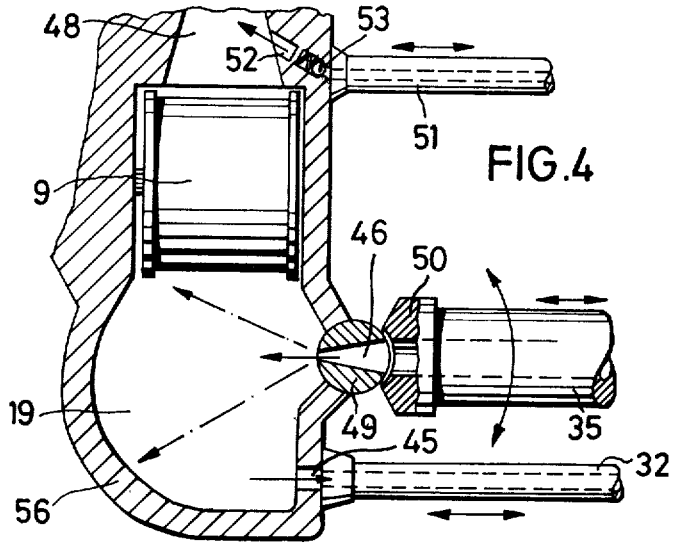
FIG. 4 shows a partial section through an embodiment similar to that shown in FIG. 2, having additional connection openings and connection lines for the maintenance unit.

In the embodiment according to FIG. 4, which corresponds generally to the embodiment shown in FIG. 3, a housing covering housing 56 has been eliminated. In this embodiment, a ball 49 having a tapered passage and being held in the wall of housing 56 serves as connection opening 46. Compressed air line 35 can be attached to this ball 49 with a spacer 50 of appropriate configuration, thereby providing sufficient sealing here also. In addition to the advance motion to the housing and connection opening 46, compressed air line 35 can also perform a swivel motion, thereby taking along ball 49, so that the direction of the airstream can be altered as shown by the illustrated arrows.

In the embodiment according to FIG. 4, the spinning unit has a further connection opening, designed as the mouth of a channel 52 leading to section 48 of fibre supply channel 11. A suction or compressed air line 51 of maintenance unit 22 can be advanced to this channel 52, which is closed by a valve 53, for cleaning section 48. This cleaning is desired preferably when the spinning unit is stopped. In this connection, it is conceivable, especially in the case of a design in accordance with FIG. 2, to place a suction line against the mouth of section 48 from the outside for removing the impurities loosened by the stream of compressed air from channel 52.

Figure 5:
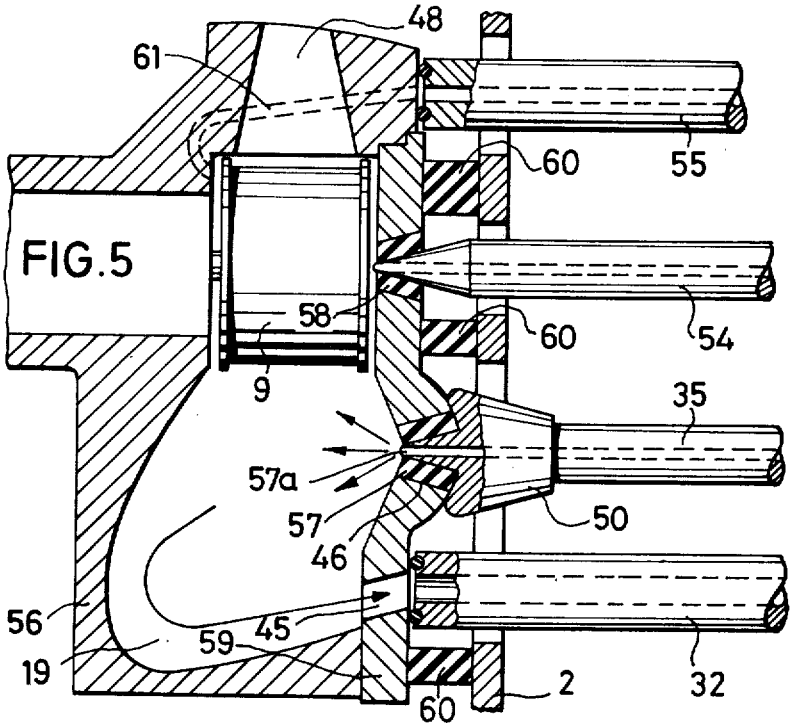
FIG. 5 shows a partial section through an embodiment similar to that shown in FIG. 4.

In principle the embodiment according to FIG. 5 also corresponds to the embodiment according to FIGS. 3 or 4. Collection chamber 19, located beneath opener roller 9, has a connection opening 45 for a suction line 32 in its end at the area of the base. Provided in the area thereabove is a connection opening 46, which is closed by a rubber insert 57. A nozzle **57*a* of a compressed air line 35 can penetrate into this rubber insert 57 by widening the rubber ring, which is otherwise closed. Compressed air line 35 is seated on the semispherical outside of housing section 59 of housing 56 with a spacer 50 and can be swivelled thereon so that here, also, the compressed air streams ca be directed in a given manner, similar to the embodiment according to FIG. 4. It should also be pointed out that in this embodiment the rear wall of housing 56, which is located opposite connection openings 45 and 46, is clearly designed as an airstream guide surface directed toward connection opening 45 for suction line 32. When compressed air line 35 of the maintenance unit is retracted in the case of this embodiment, rubber insert 57** closes completely again, thereby preventing infiltrated air in this area.

In the embodiment according to FIG. 5, housing section 59 is designed in the form of a lid, which closes the area of the opener roller and collection chamber 19. It is connected with the inner wall of housing 2, which can be swivelled away in an unillustrated manner, by means of an elastic member 60, for example a rubber ring, so that swivelling away housing 2 causes lid 59 to open, thereby providing access to the aforementioned area.

In the embodiment according to FIG. 5, the end walls of opener roller 9 can also be cleaned by maintenance unit 22. There are two additional compressed air lines 54 and 55 provided for this purpose, which can be advanced to corresponding connection openings in housing 56. A rubber insert 58, similar to rubber insert 57, is attached in lid-like housing section 59 in the area of the front end of opener roller 9 and can be opened by needle-like compressed air line 54. A compressed air channel 61 leads to the rear end of opener roller 9; compressed air channel 61 also opens into the end of housing 56 and is associated to compressed air line 55, whose mouth has a seal.

Figure 6:
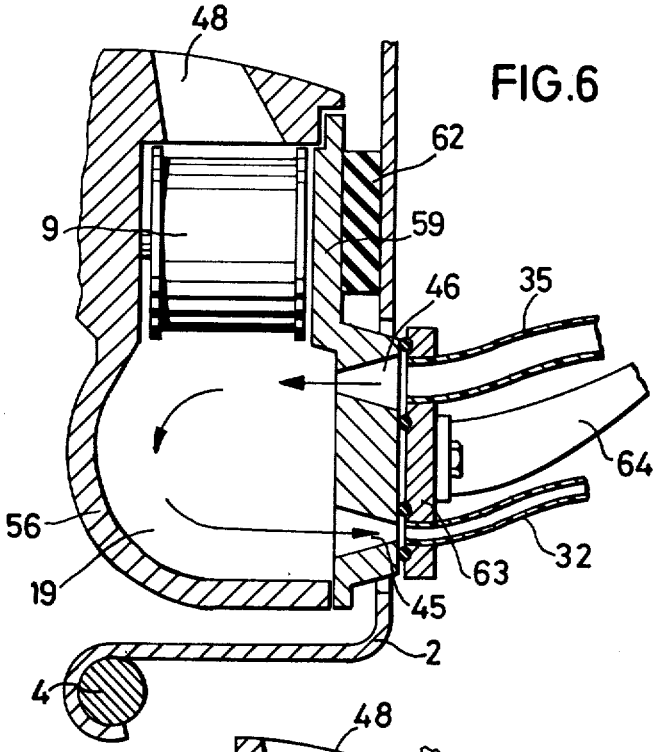
FIG. 6 shows a partial section through an embodiment similar to that shown in FIG. 2.

In the embodiment according to FIG. 6, housing 56 is also closed by a lid-like housing section 59 in the area of an opener roller 9 and collection chamber 19; housing section 59 is connected with housing 2, which can be swivelled away about axle 4, by means of an elastic spacer 62. Here, also, spacer 62 is designed as an elastic member for the same reason as in the embodiment according to FIG. 5, so that lid-like housing section 59 can center on housing 56 itself, without overdefinition. It is also possible to provide alignment pins between lid-like housing section 59 and housing 56.

In the embodiment according to FIG. 6, suction line 32 and compressed air line 35 have a common adjusting member 64 which supports a guide member 63, which can be pressed against connection openings 45 and 46, into which suction line 32 and compressed air line 35 open, their mouths being surrounded by seals.

Figure 7:
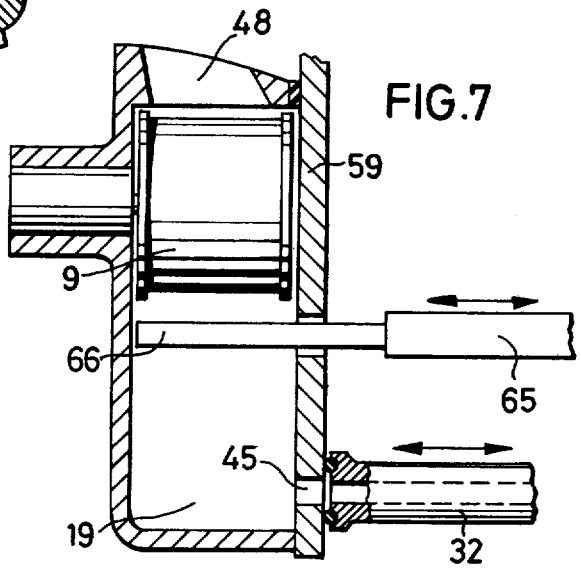
FIG. 7 shows a partial section through a further embodiment having additional screening means which can be inserted into the spinning unit.

Illustrated in FIG. 7 is a very simple embodiment in which the maintenance unit needs only suction means which can be advanced to a connection opening 45 in housing 56 in the area of the base of collection chamber 19 by means of a suction line 32. In order to prevent the airstream in the area of the opener roller from being influenced, lid-like housing section 59 has a further opening in the area above connection opening 45; a baffle 66 can be inserted through this further opening with the aid of adjusting means 65 of the maintenance unit to screen the removal opening during the suction operation. Baffle 66 can be designed as a partition. However it is also possible to design it as a brush-like cleaning means which can simultaneously free the area of the lower edge of the removal opening of any deposits of impurities which may cling there. In this connection, it is possible for the brush member to rotate.

Figure 8:
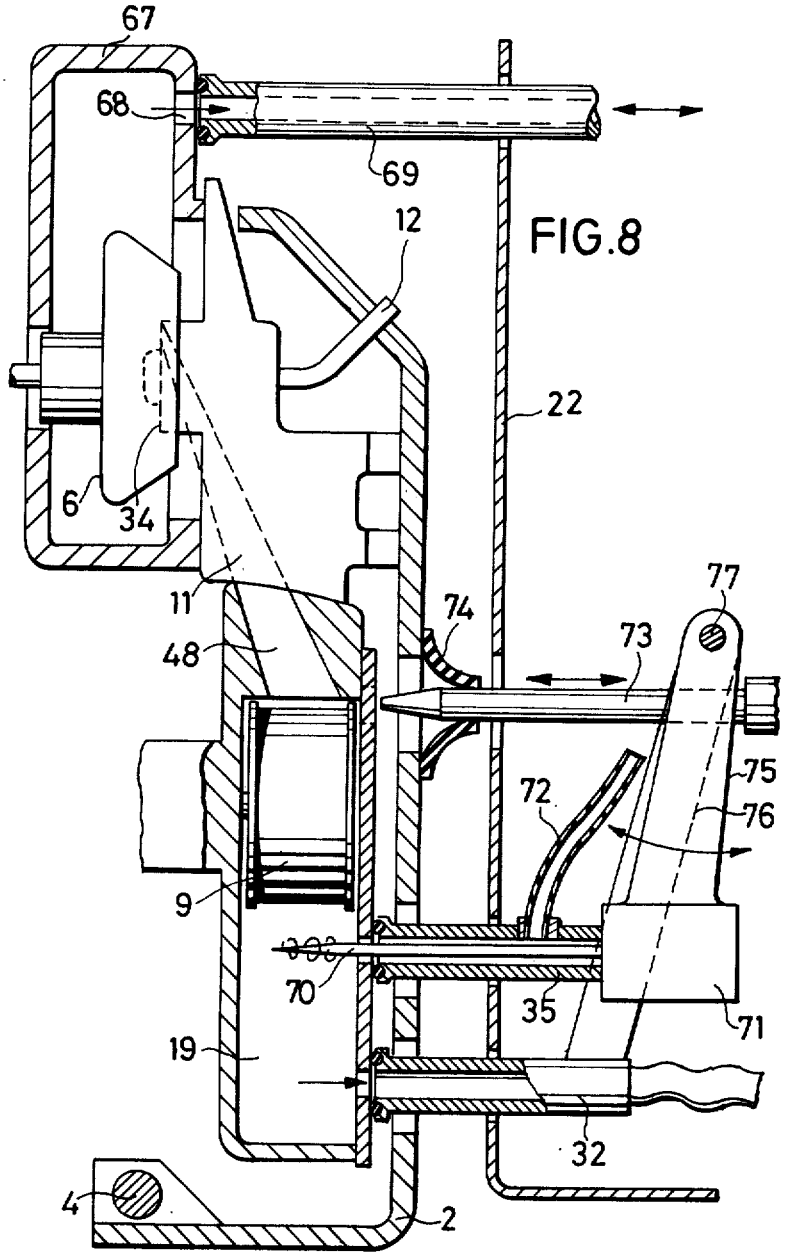
FIG. 8 shows an embodiment having connection openings arranged in various areas of the spinning unit and having additional mechanical cleaning means.

In the embodiment according to FIG. 8, a so-called fly catching needle 70, which is caused to rotate by a small motor, can be introduced into collection chamber 19 through a compressed air line 35. This fly catching needle serves to loosen any fly deposits or strands, etc. which may be located beneath the opener roller and which might possibly not be able to be loosened by an airstream alone. In the illustrated embodiment, suction lines 32 and 35 are mounted about a common axle 77 of maintenance unit 22 on separately pivotable lever arms 75 and 76, with lever arm 75 also supporting the drive motor 71 of the fly catching needle.

In the embodiment according to FIG. 8, maintenance unit 22 is also equipped with a line 73, which can be advanced to a further connection opening of spinning unit 1. This connection opening is arranged in the area of the fibre feed. Line 73 has a funnel-shaped widening elastic joining member 74, which is placed in a contacting relationship with the outer wall of housing 2 in a sealing manner. Line 73 can be employed as either a suction or compressed air line or, if desired, for intermittent suction and blowing in order to perform the cleaning operation.

In the embodiment according to FIG. 8, maintenance unit 22 is also equipped with a further line 69, which is associated to a connection opening in a housing 67 surrounding spinning rotor 6. Any impurities or fibre strand, etc. which are deposited in the chamber surrounding spinning rotor 6 can be sucked away through this connection opening. A suction draft of sufficient strength can be generated periodically herefor. It is therefore possible to maintain only a relatively low underpressure in rotor housing 67 during normal spinning operations, as this underpressure must not perform any cleaning, since sufficient cleaning can be performed by travelling maintenance unit 22.

Figure 9:
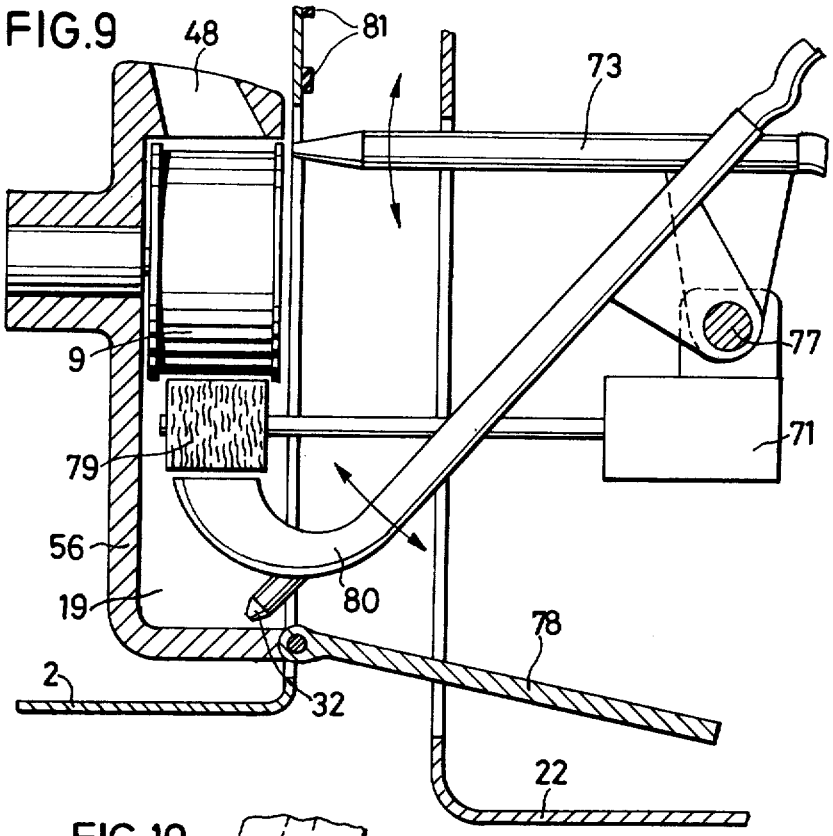
FIG. 9 shows a partial section through an embodiment having a wide connection opening for the simultaneous insertion of pneumatic and mechanical cleaning means.

Illustrated in FIG. 9 is an embodiment whose full function is only employed when the respective spinning unit is to be cleaned after an interruption in the spinning operation. In this connection, it is conceivable for collection chamber 19 to be dimensioned in such a manner as to ensure that it will be sufficient for a given period of operation, after which the spinning process is then interrupted and a full cleaning operation is performed. It is also possible to employ the embodiment according to FIG. 9 in conjunction with another maintenance unit, in which case the full cleaning operation can then only be performed if the respective spinning unit is stopped anyway, as a result of a thread break, etc. for example. Housing 56 has a lid 78, which can be folded away, thereby exposing the front of collection chamber 19 and the end of opener roller 9, so that they are freely accessible for the cleaning means of maintenance unit 22. There is no difficulty in equipping the maintenance unit with means for opening lid 78 before the maintenance unit is advanced to the cleaning position.

The maintenance unit in FIG. 9 contains a cleaning brush 79 which is pivotally arranged about an axle 77 and which has a drive motor 71; cleaning brush 79 can be swivelled to the periphery of opener roller 9, thereby permitting it to be cleaned with brushes. Associated to this cleaning brush 79 are exhausting means 80 which can also be pivoted about axle 77 and which suck away the fibre dust or other impurities, etc. stirred up by the brush. After cleaning brush 79 has been swivelled away, exhausting means 80 can be swivelled all the way to opener roller 9, thereby providing supplementary cleaning by means of suction. During this period, a suction pipe 32, of which only a portion can be seen, also removes the impurities collected in collection chamber 19.

Moreover, the maintenance unit shown in FIG. 9 also has a suction or blow pipe 73 which can be advanced to the upper area of opener roller 9 and pivoted about axle 77 within certain limits. For example, it is possible for pipe 73 to describe a path along those points at which fly strands, etc. can be deposited.

Figure 10:
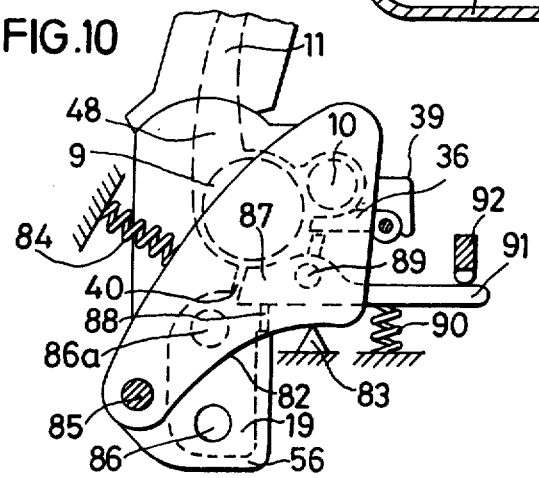
FIG. 10 shows a partial view of a further embodiment having a lid which can be swivelled for performing maintenance.

The view in FIG. 10 shows an embodiment which is similar to that in FIG. 9, in which there is a lid 82, which cannot be opened forwardly, but pivoted to the side about an axle 85 against the force of a spring 84. During normal operations, the lid is retained in the illustrated operating position by spring 84, being in a supporting relationship with a stop 83. Lid 82 is designed in such a manner that it also covers the area of silver advance. In the position illustrated in FIG. 10, it leaves the connection opening 86 free for suction means of the maintenance unit, with which collection chamber 19 can be emptied as needed. It can then be swivelled away by the maintenance unit for a full cleaning, thereby also providing access to a further connection opening 86*a* or the entire area.

In FIG. 10, removal opening 40 can also be closed by an adjustable flap 87. Flap 87 can be pivoted about an axle 89 against the force of a compression spring 90; sealing means 88 seal collection chamber 19 off from the outside, irregardless of the position of flap 87. Flap 87 can be actuated by a pressure finger 92 of the maintenance unit in such a manner that removal opening 40 is closed by means of lever 91 as long as the maintenance unit is emptying collection chamber 19, thereby ensuring that the spinning process cannot be affected by infiltrated air during the emptying operation.

Figure 11:
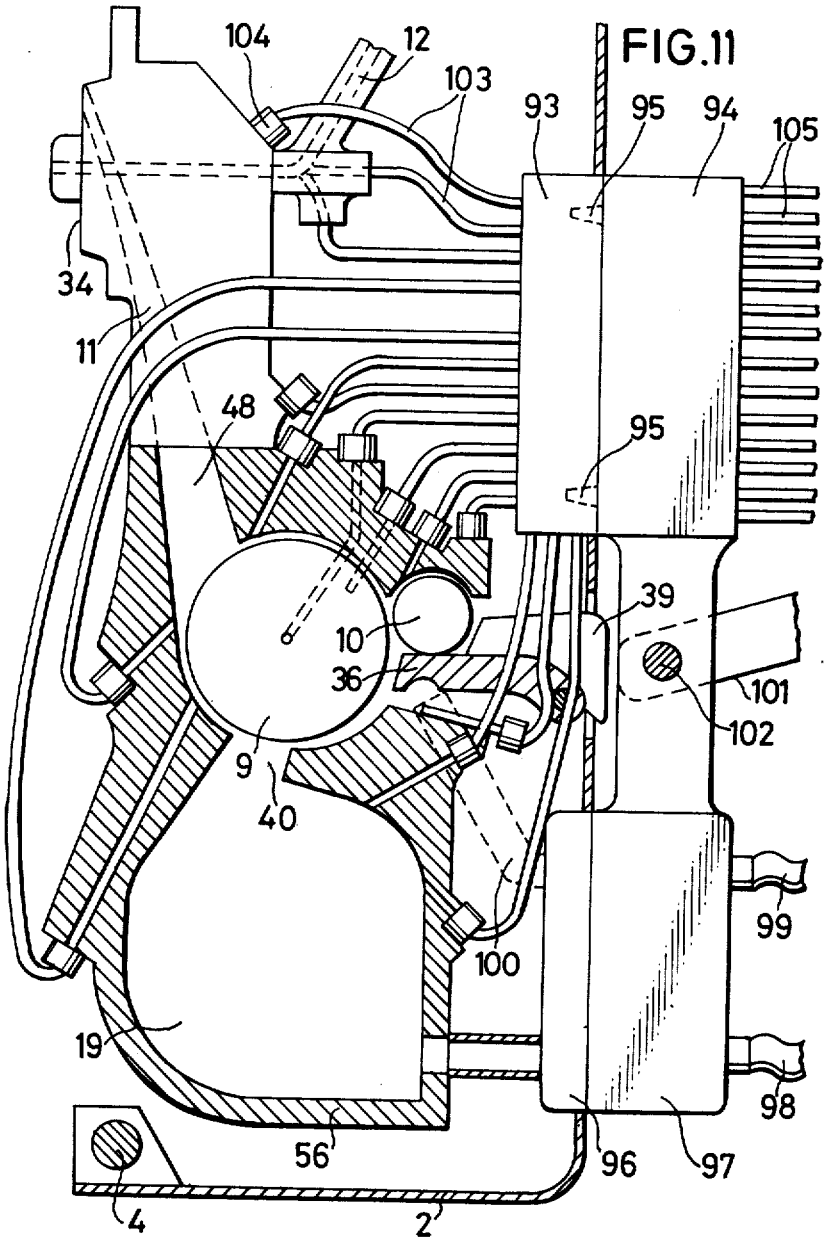
FIG. 11 shows a partial section through an embodiment having a plurality of cleaning points and central connection means for the maintenance unit.

FIG. 11 shows an embodiment in which automatic full cleaning of the entire supply and opening means, as well as the area of the spinning rotor, can be performed. Compressed air and/or suction channels, which are connected with a common connection plate 93 by means of lines 103, open at those locations in which fibres or impurities can collect. The channels are run in the area of supply roller 10, supply undercasing 36, opener roller 9, section 48 of the fibre supply channel, as well as in fibre supply channel 11 and yarn removal channel 12 of insert 34. The channels are preferably connected to common connection plate 93 by means of elastic lines 103, which are connected with the channels by special connection means 104. Lines 103 can be dimensioned in such a manner that it is, in principle, possible to design the entire supply and opening means as a common unit which can be pivoted about axle 4 or, as shown in the illustrated embodiment, to provide a stationary housing 56 for supply roller 10 and opener roller 9, housing 56 being closed by a pivotable cover 2, which supports insert 34, as well as connection plate 93 in the illustrated embodiment.

Associated to connection plate 93 is a counterplate 94 of the maintenance unit, which can be connected with connection plate 93 in a plug-and-socket manner, with centering being performed with the aid of tapered pins 95. In most cases, it is practical to connect the lines 105 leading from counterplate 94 of the maintenance unit with a compressed-air and/or suction source by means of unillustrated valves in such a manner as to provide cycle control in accordance with a given programme. In this connection, the control can be such that the individual cleaning points are subjected to suction and- /or compressed air in cycles, one after the other, so that a sufficient effect is provided at each point without requiring an excessively expensive and complicated source of compressed air or suction. It is also practical for the control system to be designed in such a manner that the airstreams are provided at intervals, as this produces an especially intensive cleaning effect.

It is possible to clean at least certain areas without inerrupting the spinning process. This is possible, in particular, when the compressed air and/or suction is applied only briefly and in bursts and, in addition, is controlled in such a manner that the overall airstream is not impaired.

Counterplate 94 is coupled with a further counterplate 97, arranged opposite a connection plate 96. Counterplate 97 is connected with a suction line 98, while connection plate 96 leads to a suction opening in the area of the base of a cleaning chamber 19 arranged beneath opener roller 9, by means of which the impurities removed from the opened fibrous material can be sucked away. Counterplates 94 and 97 are supported on a common lever 101 by means of a joint 102; lever 101 belongs to the travelling maintenance unit and can be advanced to the respective spinning unit to be cleaned.

Moreover, connection plate 96 can also be equipped with a connection 100, illustrated by a dashed line, to which a suction line 99 of counterplate 97 of the maintenance unit is associated. Line 100 leads to the sliver feed in the area of an undercasing 36 which operates conjointly with supply roller 10. This suction line, through which the impurities which are loosened from this area with the aid of a stream of compressed air can be removed, is necessary in order to avoid disturbing the spinning process during the cleaning operation.

In the embodiment according to FIG. 11, a stream of compressed air is also directed at removal opening 40 by means of a channel; this stream serves to blow in a supporting airstream while the impurities contained in collection chamber 19 are being sucked away in order to prevent the suction required for cleaning from affecting the area of opener roller 9 excessively, even if very high suction drafts, which permit effective cleaning, are employed. Only if the airstream in the area of the opener roller is protected by screening of this nature and is not, or not significantly, impaired is it possible for the spinning process to continue to be performed, even with intermittent operation. If these measures were not taken, the possibility of poorer yarn, or at least yarn of a different quality, being spun during the cleaning period would have to be expected.

Since virtually all of the aforementioned cleaning channels are connected with the same suction or compressed-air source, however differing suction drafts and compressed air streams are desired at the individual cleaning points, the individual lines must be appropriately dimensioned or equipped with reducing valves or similar means in order to provide the desired effect. It is practical for these means to be contained in the maintenance unit, so that they are not required at each spinning unit.

Figure 12:
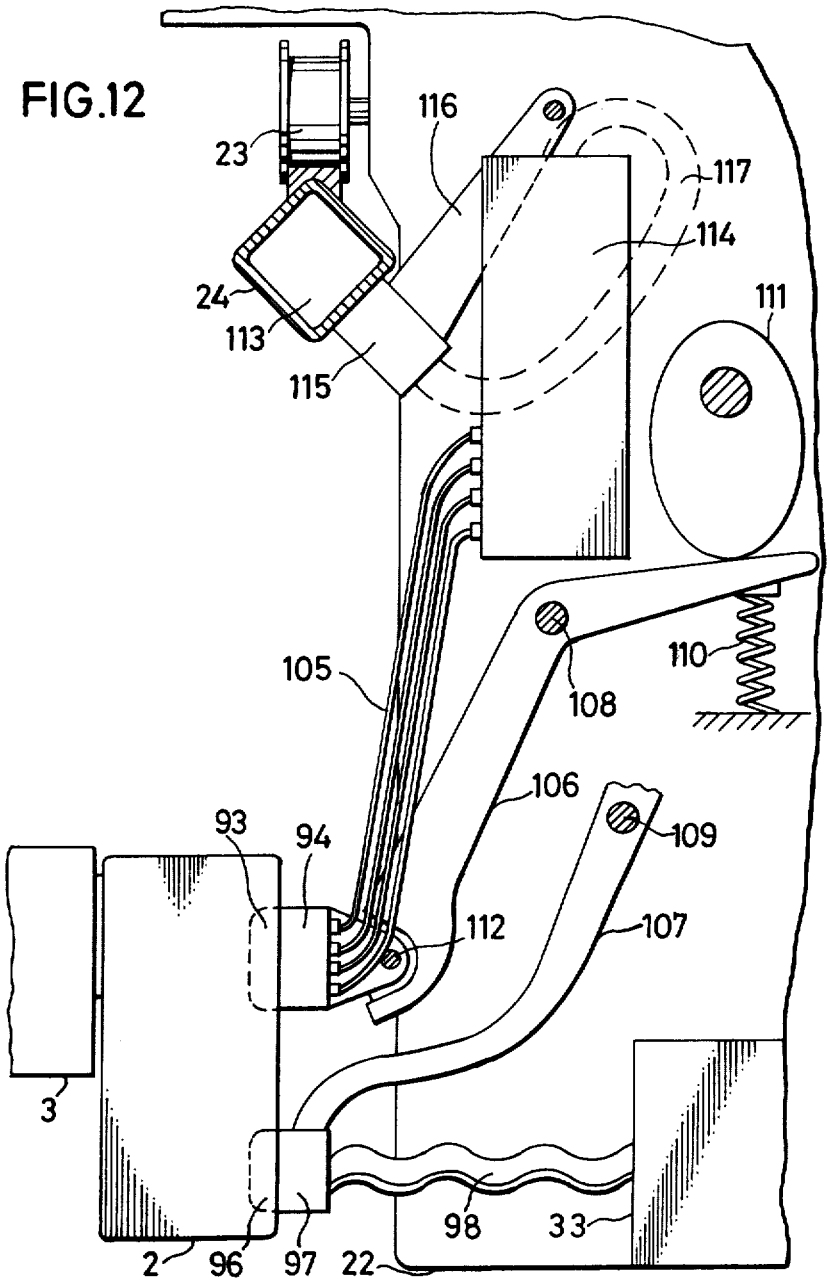
FIG. 12 shows a view of a maintenance unit having a connection to a suction and/or compressed-air source.

Shown in FIG. 12 is the maintenance unit 22 belonging to the embodiment according to FIG. 11. This maintenance unit 22 travels on a rail 24 with wheels 23 and on further unillustrated wheels and rails arranged at the bottom of maintenance unit 22. Rail 24 is designed as a hollow section 113, which serves as a central compressed air supply line for the entire open-end spinning machine. This hollow section has connection possibilities for a connection member 115 of maintenance unit 22 in the area of each individual spinning unit 1; connection member 115 is arranged on a swivel arm 116 and can be advanced to hollow section 113. Connection member 115 connects a valve unit 114 with the central compressed air line, to which the individual compressed air lines 105 are attached, by means of a line 117. It is practical for valve unit 114 to also contain the control means which control the sequence in which the individual cleaning points are subjected to compressed air in accordance with the aforementioned programme.

Valve unit 114 is connected with counterplate 94 by means of the aforementioned elastic lines 105; counterplate 94 is movably arranged about a joint 112 on a lever 106, which can be pivoted about an axle 108 of the maintenance unit. A spring 110 and an eccentric 111, which cause the advance motion toward connection plate 93, act upon lever 106, whereby counterplate 94 can centre itself on connection plate 93 in a sufficient manner as a result of joint 112.

In addition to the aforementioned parts, maintenance unit 22 is also equipped with a further lever 107, which can be pivoted about an axle 109, whereby the swivel motion can be controlled in a manner similar to that described in connection with lever 106 by means of an eccentric and a spring. This lever 107 supports counterplate 97, which is connected with suction line 98. Counterplate 97 is advanced to connection plate 96, which has a connection line to collection chamber 19, arranged beneath the opener roller, whereby permitting the inpurities to be sucked away. Suction line 98 leads to an impurities chamber 33, to which an underpressure source, for example a vacuum pump driven by an electric motor, can be attached in an unillustrated manner.

It is readily possible to combine the advantageous cleaning possibilities for the individual functional areas of the spinning unit, especially as described in connection with FIGS. 11 and 12, in a different maintenance unit, for example in a maintenance unit performing start-spinning or bobbin changing. A maintenance unit of this type containing these cleaning means can also be employed if the impurities are removed from collection chamber 19 in a different manner, for example by mechanical conveying means or suction means which are rigidly attached to the machine and which serve a plurality or all of the spinning units simultaneously.

Obviously, many modifications and variations of the present invention are possible in the light of the above teachings. It should therefore be understood that within the scope of the appended claims, the invention may be practiced otherwise than as specifically described.

I claim:

1. An open-end spinning machine having a plurality of spinning units arranged one next to the other, each of said spinning units having supply and opening means with a removal opening for impurities in the area of an opener roller, each of said removal openings being followed by a collection chamber for said impurities, each of said collection chambers having a connection opening for exhausting means, said exhausting means being arranged on a maintenance unit travelling along said open-end spinning machine and containing means for advancement to said connection opening.

2. The open-end spinning machine according to claim 1, in which said connection openings of said spinning units have closing means which can be opened with means of said maintenance unit.

3. The open-end spinning machine according to claim 1, in which said maintenance unit has screening means which can be placed in the collection chamber between said removal opening and said connection opening for the exhausting means of said maintenance unit.

4. The open-end spinning machine according to claim 3, in which said screening means is designed as cleaning means which can be advanced to the area of said removal openings of said spinning units.

5. The open-end spinning machine according to claim 1, in which said collection chamber has a further connection opening for a compressed air line of said maintenance unit, said further opening being arranged between said connection opening for the exhausting means and said removal opening.

6. The open-end spinning machine according to claim 5, in which said collection chamber has interior contours which favour the formation of an airstream between said connection openings.

7. The open-end spinning machine according to claim 5, in which said connection opening for the compressed air line contains a blow nozzle whose direction can be altered.

8. The open-end spinning machine according to claim 1, in which said maintenance unit has mechanical cleaning means which can be introduced into the collection chamber of said spinning units.

9. The open-end spinning machine according to claim 1, in which said connection openings of said collection chambers of the spinning units are attached to removable covers which close said collection chambers and cover a portion of the opener rollers.

10. The open-end spinning machine according to claim 9, in which said lid is attached to a cover which can be swivelled away from the stationary supply and opening means.

11. The open-end spinning machine according to claim 1, wherein said spinning units include further connection openings at places thereof other than said collection chambers, in which said maintenance unit is equipped with a plurality of pneumatic means which can be advanced to said further connection openings of said spinning units.

12. The open-end spinning machine according to claim 11, in which said maintenance unit is guided on a rail designed as a central pneumatic supply line.

13. The open-end spinning machine according to claim 12, in which said central pneumatic supply line has a connection point for a connection line of said maintenance unit in the area of each of said spinning units.

14. The open-end spinning machine according to claim 11, in which each spinning unit is equipped with pneumatic lines running from portions of said spinning unit to be cleaned to the further connection openings.

15. The open-end spinning machine according to claim 14, in which said further connection openings of a spinning unit are arranged in one common connection plate, to which a counterplate of said maintenance unit can be attached, said counterplate being connected with pneumatic means of said maintenance unit by means of pneumatic lines.

16. The open-end spinning machine according to claim 15, in which said connection plate of said spinning unit and said counterplate of said maintenance unit are designed in a plug-and-socket manner.

17. The open-end spinning machine according to claim 15, in which said pneumatic lines of said maintenance unit are attached to pneumatic supply means by means of valves, and wherein control means are provided for controlling said valves in a predetermined manner to effect spinning unit cleaning operation.

18. The open-end spinning machine according to claim 15, in which said pneumatic lines of said maintenance unit are attached to common pneumatic supply means and are equipped with means for generating differing airstreams.

19. The open-end spinning machine according to claim 14, wherein said portions of said spinning unit to be cleaned include the area of a supply roller of said spinning unit.

20. The open-end spinning machine according to claim 19, wherein said portions of said spinning unit to be cleaned include the area of a supply undercasing facing a supply roller of said spinning unit.

21. The open-end spinning machine according to claim 20, wherein said portions of said spinning unit to be cleaned include a fiber supply channel leading from the opener roller to a spinning rotor of said spinning unit.

22. The open-end spinning machine according to claim 21, wherein said portions of said spinning unit to be cleaned include a yarn removal channel leading from the spinning rotor of the spinning unit.

23. The open-end spinning machine according to claim 14, wherein said portions of said spinning unit to be cleaned include the area of a supply undercasing facing a supply roller of said spinning unit.

24. The open-end spinning machine according to claim 14, wherein said portions of said spinning unit to be cleaned include a fiber supply channel leading from the opener roller to a spinning rotor of said spinning unit.

25. The open-end spinning machine according to claim 14, wherein said portions of said spinning unit to be cleaned include a yarn removal channel leading from the spinning rotor of the spinning unit.

26. The open-end spinning machine according to claim 1, in which said maintenance unit is guided on a rail designed as a central penumatic supply line.

27. The open-end spinning machine according to claim 26, in which said central pneumatic supply line has a connection point for a connection line of said maintenance unit in the area of each of said spinning units.

* * * * *